United States Patent [19]

Prigent

[11] Patent Number: 4,457,895

[45] Date of Patent: Jul. 3, 1984

[54] CATALYTIC MUFFLER FOR PURIFYING THE EXHAUST GASES OF AN INTERNAL COMBUSTION ENGINE

[75] Inventor: Michel Prigent, Rueil-Malmaison, France

[73] Assignee: Institut Francais du Petrole, Rueil-Malmaison, France

[21] Appl. No.: 434,033

[22] Filed: Oct. 13, 1982

[30] Foreign Application Priority Data

Oct. 13, 1981 [FR] France ..... 81 19373

[51] Int. Cl.[3] ..... F01N 3/10

[52] U.S. Cl. ..... 422/179; 60/299; 60/302; 422/181

[58] Field of Search ..... 422/177, 218, 179–181; 60/299, 301, 302; 55/DIG. 30

[56] References Cited

U.S. PATENT DOCUMENTS

| | | | |
|---|---|---|---|
| 2,185,584 | 1/1940 | Boyce | 422/181 X |
| 3,094,394 | 6/1963 | Innes et al. | 60/299 X |
| 3,154,388 | 10/1964 | Purse | 422/179 |
| 3,197,287 | 7/1965 | Innes et al. | 422/181 |
| 3,594,131 | 7/1971 | De Palma et al. | 422/218 |
| 3,824,790 | 7/1974 | Thomaides | 422/179 X |
| 4,124,357 | 11/1978 | Akimoto et al. | 422/179 X |
| 4,148,860 | 4/1979 | Goedicke | 422/176 |
| 4,251,487 | 2/1981 | Goedicke | 422/179 |

FOREIGN PATENT DOCUMENTS

| | | | |
|---|---|---|---|
| 2310843 | 9/1974 | Fed. Rep. of Germany . | |
| 1299792 | 6/1962 | France . | |
| 2198536 | 3/1974 | France | 422/179 |
| 2270444 | 3/1978 | France . | |
| 2373677 | 7/1978 | France . | |
| 1435608 | 5/1976 | United Kingdom . | |

OTHER PUBLICATIONS

Hawley, G. G., *The Condensed Chemical Dictionary*, Reinhold Co., 8th Edition, pp. 183, 874, 875, 956.

*Primary Examiner*—Richard L. Chiesa
*Attorney, Agent, or Firm*—Millen & White

[57] ABSTRACT

An elongate catalytic muffler of the radial flow type for purifying the exhaust gases of an internal combustion engine, comprises a tubular casing having a gas inlet at one end and a gas outlet at the other end. Two co-axial substantially parallel frustra-conical grids of decreasing cross-section from the inlet end to the outlet end of the muffler define, with cup-like end walls, a catalyst chamber compression means is provided for axially displacing one of said end walls towards the other, so as to compress the catalyst mass in said chamber, and with said compression means being protected by tight separating means from the action of the exhaust gases treated in the muffler.

9 Claims, 1 Drawing Figure

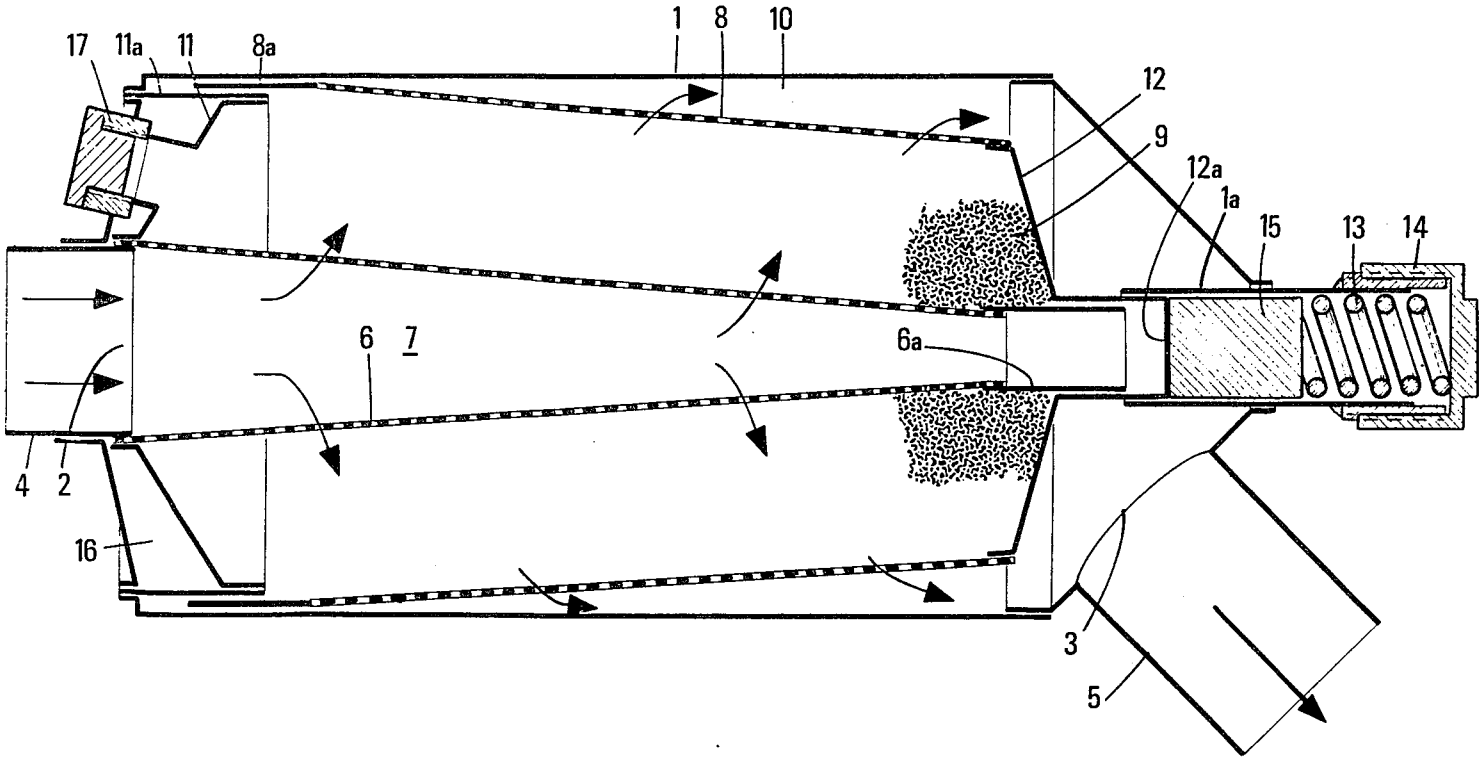
14
13
15
1a
12a
12
9
3
5
6a
10
8
1
7
6
8a
11
11a
17
16
2
4

CATALYTIC MUFFLER FOR PURIFYING THE EXHAUST GASES OF AN INTERNAL COMBUSTION ENGINE

BACKGROUND OF THE INVENTION

The present invention concerns a new muffler which can be used, in particular, for the catalytic purification of the gases produced by an internal combustion engine.

It is known to remove the polluting products such as unburnt hydrocarbons, nitrogen oxides and carbon etc... contained in the exhaust gases of an internal combustion engine by contacting said gases with a catalyst, formed of particles (balls or extrudates for example), which favours the reduction or oxidation reactions of the polluting products, at temperatures lower than that necessary to achieve the complete removal of said polluting products, in the absence of catalyst.

Catalytic mufflers are, for example, described in French Pat. Nos. 2,373,677, 2,198,536, and 1,299,792, as well as in the German Pat. No. 2,310,843.

One of the problems encountered when using these prior art mufflers is that of the formation of voids within the catalyst bed after a more or less long period of time in use.

As a matter of fact, it is not possible to avoid the decrease of the catalyst volume introduced into a muffler as time lapses: the main reasons are the lack of packing of the catalyst, the thermal skrinkage of the particles of which it is formed, the breaking of certain grains more brittle than the others, etc... In the catalytic mufflers with flat bed and downward gas flow (developed by General Motors in U.S.A. for example) this volume decrease is not very serious since the catalyst is compressed by its own weight, and by the effect of the gas velocity against the lower grid of the catalytic muffler.

However, every time there is insufficient room available to house a flat bed catalytic muffler, it is necessary to make use of cylindrical mufflers of the "radial flow" type, such as, for example, as that described in the French Pat. No. 7,406,395.

In these mufflers with radial flow a void is generated at the upper part of the muffler where through gases flow upwardly. The balls or grains of catalyst are then lifted by the gas flow and their motion results in a wear of these particles which may be very rapid.

It is already known, from U.S. Pat. No. 3,594,131, to make use of a catalytic muffler for purifying the exhaust gases of an internal combustion engine, with said muffler comprising an elongate body including an admission gas chamber and an exhaust gas chamber, provided with ports substantially placed at the respective two ends of the muffler, an elongate annular space adapted to contain a purification catalyst formed of particles placed inside said elongate body and separating said gas admission and exhaust chambers. The space is defined by walls which comprise two lateral walls provided with perforations, at least one of the walls defining said space being mounted so as to be slidable in the direction of the length of the muffler. In addition there is included means for pressing the catalyst by action on said sliding wall, which tends to reduce the volume of said space adapted to contain the catalyst.

The advantage of this type of muffler is to maintain the catalyst compressed, and to avoid the formation of voids within the catalyst bed.

However, in the device of the type described in the U.S. Pat. No. 3,594,131, compression of the catalyst particles results either from the action of the gravity acting on a horizontal wall, (embodiment illustrated in FIG. 1 of this prior patent), or from the action of resilient means such as a spring, but said spring is then in contact with the hot exhaust gases, which is likely to result in a deterioration of the mechanical properties of the spring (embodiment illustrated in FIG. 2 of U.S. Pat. No. 3,594,131).

SUMMARY OF THE INVENTION

This disadvantage is avoided with the device according to the invention by providing means for compressing the catalyst which are separated from the gas admission chamber by a tight wall which protects the compression means and makes its replacement easier.

According to a preferred embodiment of the catalyst muffler according to the invention, at least one of the lateral perforate walls defining the catalyst space is axially slidable inside the muffler, and a spring is placed outside the muffler, (so as to avoid the effect of high temperatures), and presses against the slidable wall through an intermediate member or core made of a refractory ceramic material such as sintered alumina, sintered titanium oxide or zirconium oxide etc...

In the muffler according to this invention, the volume decrease of the catalyst may reach 10 to 15% without formation of any voids.

This type of muffler is particularly well adapted to the use of lead proof catalysts formed of particles which must operate at high temperature. As a matter of fact, the catalyst muffler is generally placed in the very close vicinity of the motor at the output of the exhaust manifold. In order to obtain satisfactory results, the catalytic muffler must then be compact and provide for a good holding of the catalyst which is subjected to very strong vibrations.

BRIEF DESCRIPTION OF THE DRAWING

The invention will be better understood and its advantages will be made apparent from the description of a particular non-limitative embodiment illustrated by the accompanying drawing, showing diagrammatically an axial cross-section of an embodiment of the muffler according to the invention.

DETAILED DISCUSSION OF THE INVENTION

The illustrated muffler comprises an elongate tubular casing or body 1, having a first end provided with an inlet port 2 coaxial with the tubular body wherein the gases are introduced through the admission pipe 4 secured to the body 1. At the other end of the body 1, is also provided a port 3, i.e., an outlet port 3 spaced apart from the axis of body 1, wherethrough the gases evolve from the muffler by passing through a discharge pipe 5 rigidly secured to the body 1. Pipes 4 and 5 may be secured onto body 1 by any convenient means and particularly by welding.

The ends of pipes 4 and 5, outside body 1, make possible the serial connection of the muffler in a flow circuit of a gas to be treated. Particularly, the muffler may be connected to exhaust pipes of an internal combustion engine.

Inside the tubular body 1 is placed an internal perforate grid 6 defining a gas admission chamber 7.

This chamber directly communicates with port 2 and has such a shape that its cross-sectional area, in a plane perpendicular to the direction of introduction of the gases in the muffler, progressively decreases as it is more distant from the admission port 2.

In the case illustrated in FIG. 1, the grid 6, consisting of an expanded metal plate, defines a chamber 7 of frusto-conical shape. This grid is secured, for example by welding, to the end of pipe 4 corresponding to port 2.

The device comprises a second or external grid 8, formed of expanded metal. This second grid 8, of larger area than that of grid 6, has the shape of the lateral surface of a cone frustrum whose section, by a plane perpendicular to the direction of introduction of the gases in the muffler, decreases as it is more distant from port 2.

The cone frustrum defined by the external grid 8 has substantially the same height as that defined by the internal grid 6.

The grid 8 is placed around the grid 6 in such a manner that the generatrices of the grid surfaces are substantially parallel. Otherwise stated, the grids 6 and 8 determine therebetween an annular space 8 of substantially constant thickness or width.

This annular space is closed at one of its ends by an unperforated cross-cup 11, surrounding the internal grid 6 at the level of port 2 and secured to the end of the internal grid 6 corresponding to the section of greatest diameter of said grid. Another cross-cup 12, having a closed bottom **12*a* and secured to the external grid 8 at the level of its smallest cross-sectional diameter, obturates the annular space 9** at its other end.

At its end corresponding to the section of greatest diameter, the external grid 8 is secured to a ring **8*a*, slidably mounted on a corresponding ring 11*a* which connects the cross-cup 11 to the casing or body 1**.

The bottom of the cup 12 secured to the end of the external grid 8 corresponding to the section of smallest diameter thereof is slidably mounted on a ring **6*a* secured to the end of the internal grid 6** corresponding to the section of smallest diameter of said grid.

The bottom **12*a* also slides in a sleeve 1*a* passing through the casing or body 1**.

The part of this grid **1*a* located outside the muffler contains compression means such as a spring 13 which is retained by a tight cap 14, and presses against the bottom 12*a* of the cup 12, through an intermediate cylindrical member or core 15** made of thermally insulating material such as a ceramic, like sintered alumina, sintered titanium oxide or sintered zirconium oxide.

A plug 17 secured to the cross-cup 11 permits the introduction, into the annular space 9, of the catalyst product formed as grains or balls of a greater size than that of the perforations of grids 6 and 8.

The grid 8 defines with the internal wall of body 1 a collecting space or exhaust chamber 10 having preferably a section which as measured perpendicularly to the direction of introduction of the gases in the muffler, increases in proportion to its distance from the admission port 2.

Preferably, the cup 11 is provided with thermal insulating means. These means consist, for example, of a tight annular chamber 16 formed by an extension of body 1, upstream of the cup 11 with reference to the direction of the gas flow through the muffler.

The operation of the device is as follows: the gases (whose flow is indicated by arrows on the drawing) are introduced through pipe 4 into the muffler and, more particularly, into the admission chamber 7. Then, they pass through the annular space 9 where they are contacted with the catalyst. Finally, they reach the collecting zone 10 and are discharged therefrom through pipe 5.

As the volume of the catalyst bed decreases, the spring 13, taking its bearing on the cap 14 and the bottom **12*a* of the cup 12 through the intermediate of the ceramic core member 15, pushes away the grid 8 which slides along the axis of grid 6** towards the inlet of the muffler.

The volume of the chamber 9 will preferably be such that the space velocity of the gas flow, defined as the ratio of the gas hourly flow rate through the muffler to the catalyst volume in chamber 9, be is lower than 400,000 $(\text{hour})^{-1}$, and preferably less than 300 000 $(\text{hour})^{-1}$, which corresponds, for a motor vehicle, to a volume of at least 0.5 liter per liter of cylinder capacity of the engine.

Modifications may be brought without departing from the scope of the present invention. In particular, the cross-section of the muffler is not necessarily circular but may be polygonal, elliptic or oval, so that the muffler be more in the motor vehicles.

The tight chamber 16 is provided in order to thermally insulate the cross-cup 11, so that at the vicinity of this cup the temperature of the catalyst bed is sufficient to initiate the oxidation reactions of the gases. It may be replaced by any other device such as a coating layer of a thermally insulating material, on the external face of said cup.

It is also possible to provide for a thermal protection of the external surface of the muffler so as to obtain, a more rapid temperature increase of the catalyst bed when starting the engine.

Moreover, the generatrices of grids 6 and 8 may be not parallel to each other and the external grid may be cylindrical instead of having the frustra-conical shape shown in the drawings which offers however the advantage of a reduced size of the tubular body 1.

What is claimed is:

1. A catalytic muffler for purifying the exhaust gases of an internal combustion engine, comprising an elongate body having gas admission and gas exhaust chambers provided with respective ports located substantially at the respective two ends of the muffler; first and second laterally arranged perforate walls spaced from each other in said body to define an annular elongate space adapted for containing a particulate purification catalyst therein, said first and second perforate walls separating said gas admission and exhaust chambers, and at least said second perforate wall being slidably mounted in the longitudinal direction of the muffler within a sleeve passing through the wall of said tubular body; and catalyst compressing means associated with said slidable second perforate wall for acting thereon to reduce the volume of said annular space for compressing particulate catalyst contained therein, and wherein said catalyst compressing means is located outside said elongate body, and separated from said slidable second perforate wall by thermal insulating means, with said thermal insulating means being interposed between said catalyst compressing means and the bottom portion of said second lateral wall.

2. A catalytic muffler according to claim 1, wherein said laterally arranged walls defining said annular space (10) comprise a frusto-conical internal wall (6) having, at its end of smallest diameter, a tubular end portion **(6*a*)**

on which a bottom portion (12,12*a*) of the second lateral wall (8) is slidably mounted.

3. A catalytic muffler according to claim 2, wherein, at its end (8*a*) opposite to said bottom portion (12*a*), the second lateral wall (8) is slidably mounted on a cup (11) surrounding said internal wall (6).

4. A catalytic muffler according to claim 3, wherein the bottom portion of said second lateral wall (12*a*) is also slidably mounted inside a sleeve (1*a*) wherein is housed said catalyst compressing means (13).

5. A catalytic muffler according to claim 1, wherein said thermal insulating means (15) comprises an intermediate core member of refractory ceramic material.

6. A catalytic muffler according to claim 5, wherein said ceramic material is sintered alumina.

7. A catalytic muffler according to claim 5, wherein said ceramic material is sintered titanium oxide.

8. A catalytic muffler according to claim 5, wherein said ceramic material is sintered zirconium oxide.

9. A catalytic muffler for purifying the exhaust gases of an internal combustion engine, comprising an elongate body having gas admission and gas exhaust chambers provided with respective ports located substantially at the respective two ends of the muffler; first and second laterally arranged perforate walls spaced from each other in said body to define an annular elongate space adapted for containing a particulate purification catalyst therein, said first and second perforate walls separating said gas admission and exhaust chambers, with at least said second perforate wall being slidably mounted in the longitudinal direction of the muffler within a sleeve passing through the wall of said tubular body, said laterally arranged walls comprising a frustoconical internal wall having at its end of smallest diameter, a tubular end portion on which a bottom portion of the second lateral wall is slidably mounted, and at its end opposite to said bottom portion, the second lateral wall is slidably mounted on a cup surrounding said internal wall; and catalyst compressing means associated with said slidable second perforate wall for acting thereon to reduce the volume of said annular space for compressing said particulate catalyst contained therein, and wherein said catalyst compressing means is housed inside said sleeve and located outside said body with thermal insulating means interposed between said catalyst compressing means and the bottom portion of said second lateral wall.

* * * * *